United States Patent [19]

Kresse

[11] 3,969,837

[45] July 20, 1976

[54] DISPLAY FIGURE

[76] Inventor: Suzanne Kresse, 7838 W. Ohio Ave., Milwaukee, Wis. 53219

[22] Filed: Mar. 6, 1975

[21] Appl. No.: 556,045

[52] U.S. Cl. ..... 40/126 R; 46/115; 116/173

[51] Int. Cl.[2] ..... G09F 19/00

[58] Field of Search ..... 40/126 R, 126 A, 106.41, 40/106.43, 129 A, 128, 37.1, 40, 124.1, 106.42; 46/32, 55, 115, 22, 27; 273/85 A, 85 B; 124/5; 116/173, 175; 248/470, 38, 48

[56] References Cited

UNITED STATES PATENTS

| | | | |
|---|---|---|---|
| 1,631,918 | 6/1927 | Correa | 273/85 R X |
| 1,728,079 | 10/1929 | Power | 40/37.1 |
| 2,648,151 | 8/1953 | Kindred | 40/126 R |
| 2,732,823 | 1/1956 | Hanson | 116/173 |
| 3,471,966 | 10/1969 | Kratzer | 46/154 |

FOREIGN PATENTS OR APPLICATIONS

| | | | |
|---|---|---|---|
| 858,222 | 1/1961 | United Kingdom | 40/126 R |

*Primary Examiner*—John F. Pitrelli
*Attorney, Agent, or Firm*—Joseph P. House, Jr.

[57] ABSTRACT

A stiff display figure panel has an elongated backing strip attached along its edges to an intermediate portion of a die cut figure to form a tube for receiving a staff upon which the figure is supported. An eyelet is attached to the top of the figure at the upper end of the backing strip for hanging the figure on a wall, and to close the end of the tube.

2 Claims, 4 Drawing Figures

DISPLAY FIGURE

BACKGROUND OF THE INVENTION

This invention relates to display figures for use by spectators at athletic contests or at other public gatherings. In the past, pennants have been widely used at such gatherings to indicate support for one of the teams or persons involved. These pennants typically comprise pointed flags bearing indicia representing the chosen team or person. The pennants are attached at their side edge to a support staff and are normally limp so that they have to be waved to display their indicia.

SUMMARY OF THE INVENTION

The display figure panel of this invention is stiff enough to remain erect without being waved. An elongated backing strip is attached along its edges to an intermediate portion of the figure panel to form a tube for receiving a staff upon which the figure can be supported. A hang tab, such as an eyelet, is preferably attached to the top of the figure above the upper end of the backing strip for hanging the figure on a wall.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

The drawings show one embodiment of the invention in which a flat display figure panel 10 represents a player for a particular baseball team. The display FIG. 10 is printed, painted, or otherwise marked on panel material which is stiff enough to remain erect without being waved. Typical panel materials include stiff felt, cardboard, plastic, etc. The outline 12 of display FIG. 10 is preferably die cut, although any suitable forming means can be employed. Outline 12 typically extends all around the panel 10, so that all edges of the panel are uneven.

Figure 1:
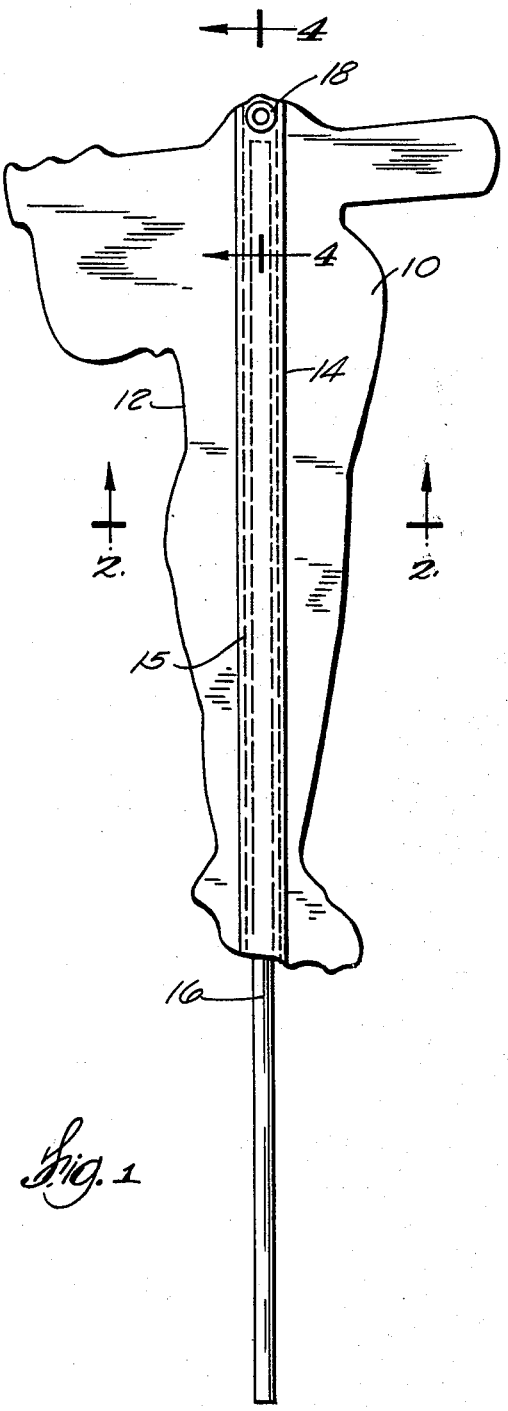
FIG. 1 is a rear elevational view of one embodiment of the invention.
Figure 2:
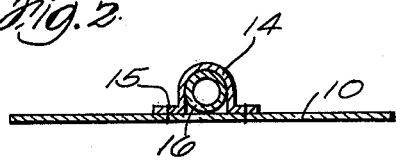
FIG. 2 is a cross sectional view taken on the line 2—2 of FIG. 1.
Figure 4:
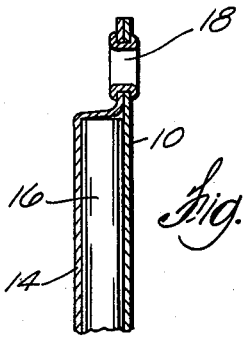
FIG. 4 is a fragmentary cross section taken along line 4—4 of FIG. 1.
Figure 3:
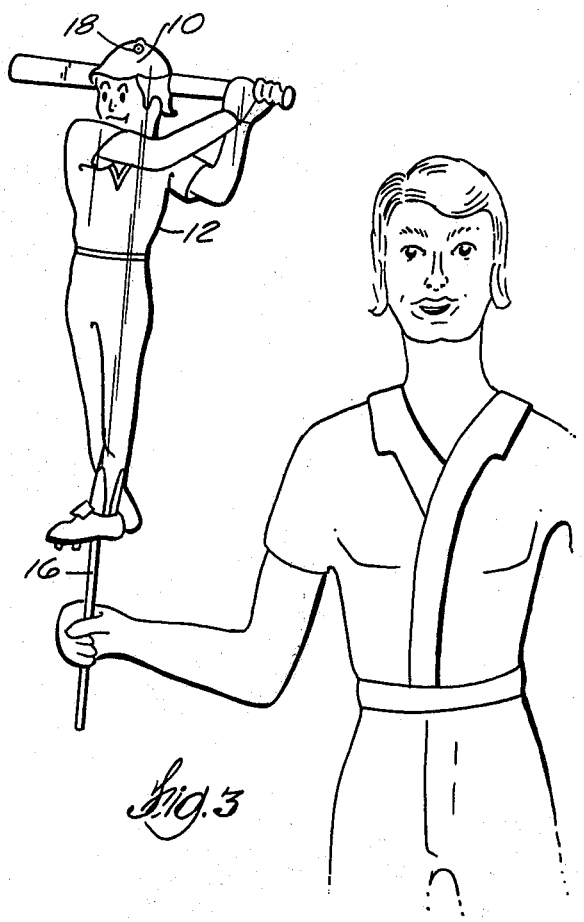
FIG. 3 is a front view of the display in use.

An elongated backing strip 14 is attached along its edges to the rear face of the display panel, preferably along a longitudinally extending medial portion thereof. The strip 14 coacts with the flat display figure panel to form a tube for receiving a staff 16 upon which the FIG. 10 can be manipulated as shown in FIG. 3. Strip 14 is preferably made of the same material as the display figure. Where display FIG. 10 is made of felt, the strip 14 is also made of felt and is preferably sewn thereon by lines of stitching 15. Where other materials are used, other appropriate fastening means can be employed. For example, with a cardboard figure, strip 14 can be made of paper, cardboard, or cloth and can be cemented to the display panel. In the case of a plastic figure, strip 14 can be made of pliable plastic and can be cemented or heat sealed to the display panel.

Hang tab means such as an eyelet 18 is preferably attached to the top of figure panel 10 at or above the upper end of strip 14 for hanging figure panel 10 on a wall after it has been used in a stadium. Staff 16 is preferably removed when FIG. 10 is hung on the wall.

It will be clear that many different figures having various shapes and pictorial displays are usable as the display panel of this invention. Strip 14 is desirably disposed intermediate the edges of the figure panel so as not to intrude upon the outline thereof. In most cases, it will be disposed along the longitudinal medial center line of the figure, but it could be disposed along the transverse medial center line thereof, depending on the shape and attitude of the figure. The strip need not be exactly centered between the edges of the figure, although this is desirable in the case of large displays, for good balance. An important feature of the invention is to dispose the strip 14 free of intrusion on the outline 12 of the figure. Hence it is disposed intermediate such edges.

The eyelet 18 desirably closes the end of the tube formed by strip 14 and coacts with the strip 14 to form an abutment or stop to prevent the staff 16 from poking through the upper end of the tube. This is a desirable safety feature.

What is claimed is:

1. A display comprising a flat figure panel made of material stiff enough to remain erect without being waved, said panel having uneven edges, an elongated backing strip attached to an intermediate portion of said figure panel to form with the portion of the panel to which it is attached a tube having one end open, said tube being disposed well within the outline of said uneven edges so as not to intrude thereon, an abutment closing the other end of the tube, a display supporting staff removably receivable through the open end of said tube and into contact with said abutment to define the fully inserted position of the staff, said abutment including a hang tab comprising an eyelet through the backing strip and panel.

2. The display of claim 1 in which the backing strip is made of the same material as the panel.

* * * * *